US006742356B2

(12) United States Patent
Saito et al.

(10) Patent No.: US 6,742,356 B2
(45) Date of Patent: Jun. 1, 2004

(54) GAS-LIQUID SEPARATOR FOR EJECTOR CYCLE

(75) Inventors: Mika Saito, Kariya (JP); Hirotsugu Takeuchi, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/339,529

(22) Filed: Jan. 9, 2003

(65) Prior Publication Data

US 2003/0126883 A1 Jul. 10, 2003

(30) Foreign Application Priority Data

Jan. 10, 2002 (JP) ..... 2002-003554

(51) Int. Cl.[7] ..... F25B 1/06; F25B 1/00
(52) U.S. Cl. ..... 62/500; 62/116; 62/512
(58) Field of Search ..... 62/500, 512, 116, 62/503

(56) References Cited

U.S. PATENT DOCUMENTS 1,958,087 A * 5/1934 Hoffman ..... 62/212
2,859,596 A * 11/1958 Evans ..... 62/471
3,710,554 A * 1/1973 Brookman ..... 96/305
4,187,695 A * 2/1980 Schumacher ..... 62/503
4,204,410 A * 5/1980 Kunz ..... 62/500
4,394,132 A * 7/1983 Taylor ..... 44/280
4,919,826 A * 4/1990 Alzner ..... 210/788
5,996,372 A * 12/1999 Koda et al. ..... 62/503
6,334,758 B1 * 1/2002 Popov ..... 417/77

FOREIGN PATENT DOCUMENTS

| | | |
|---|---|---|
| JP | 4-32461 | 3/1992 |
| JP | 5-149652 | 6/1993 |
| JP | 6-206438 | 7/1994 |
| JP | 9-250848 | 9/1997 |
| JP | 10-267472 | 10/1998 |
| JP | 11-139154 | 5/1999 |

* cited by examiner

*Primary Examiner*—William C. Doerrler
(74) *Attorney, Agent, or Firm*—Harness, Dickey & Pierce, PLC

(57) ABSTRACT

In a gas-liquid separator for an ejector cycle, a tank body is constructed such that a refrigerant sprayed from a refrigerant inlet forms a spiral stream in the tank body. The tank body has a horizontal longitudinal axis greater than a vertical axis. The refrigerant inlet is located at a distance from the horizontal longitudinal axis of the tank body such that the refrigerant sprayed from the refrigerant inlet generates a turning force and spirally flows. With this, a gas-liquid separation distance of the refrigerant increases.

25 Claims, 4 Drawing Sheets

GAS-LIQUID SEPARATOR FOR EJECTOR CYCLE

CROSS REFERENCE TO RELATED APPLICATION

This application is based on Japanese Patent Application No. 2002-3554 filed on Jan. 10, 2002, the disclosure of which is incorporated herein by reference.

FIELD OF THE INVENTION

The present invention relates to a gas-liquid separator for an ejector cycle.

BACKGROUND OF THE INVENTION

In an ejector cycle, which is a kind of a vapor compression refrigerating cycles, an ejector draws gas refrigerant from an evaporator by compressing and expanding refrigerant. Further, the ejector increases pressure of refrigerant that is to be sucked into a compressor by converting expansion energy into pressure energy, in order to decrease a power consumption of the compressor.

The refrigerant discharged in the ejector flows into a tank body of a gas-liquid separator. The gas-liquid separator 50 separates the refrigerant into gas refrigerant and liquid refrigerant by using differences of densities, that is, differences of gravities exerting on the liquid refrigerant and the gas refrigerant. In the tank body, there are a mixed refrigerant region where gas-liquid refrigerant from the ejector exists and a separated refrigerant region where completely separated refrigerant exists. The mixed refrigerant region is located in a top of the tank body and the separated refrigerant region is located in a bottom of the tank body.

Because it is preferable to increase a refrigerant stream distance from the mixed refrigerant region to the separated refrigerant region, a lateral-type tank body which vertical length is greater than a horizontal length is generally used for the separator. Here, the refrigerant stream distance is not a shortest distance between the mixed refrigerant region and the separated refrigerant region, but is the distance that the refrigerant flows to be separated into gas refrigerant and liquid refrigerant. Hereinafter, this refrigerant stream distance is referred to as a gas-liquid separation distance.

SUMMARY OF THE INVENTION

It is an object of the present invention to provide a gas-liquid separator that increases a gas-liquid separation distance of refrigerant.

It is another object of the present invention to provide a gas-liquid separator decreased in height.

In a gas-liquid separator for an ejector cycle that includes an ejector for drawing a gas refrigerant from an evaporator and increasing a pressure of refrigerant to be sucked into a compressor, a refrigerant is flowed into a tank body from the ejector and separated into a gas refrigerant and a liquid refrigerant in the tank body. The gas refrigerant is discharged from a gas refrigerant outlet toward the compressor. The liquid refrigerant is discharged from a liquid refrigerant outlet toward the evaporator. The tank body defines a refrigerant inlet through which the refrigerant is discharged into the tank body. The tank body is constructed such that the refrigerant spirally flows in the tank body.

Since the refrigerant forms a spiral stream in the tank body, a gas-liquid separation distance increases. Therefore, even in a horizontal-type tank body, the refrigerant is adequately separated into liquid refrigerant and gas refrigerant.

BRIEF DESCRIPTION OF THE DRAWINGS

Other objects, features and advantages of the present invention will become more apparent from the following detailed description made with reference to the accompanying drawings, in which.

DETAILED DESCRIPTION OF EMBODIMENTS

The first embodiment will be described hereinafter with reference to FIGS. 1 through 4C.

Figure 1A:
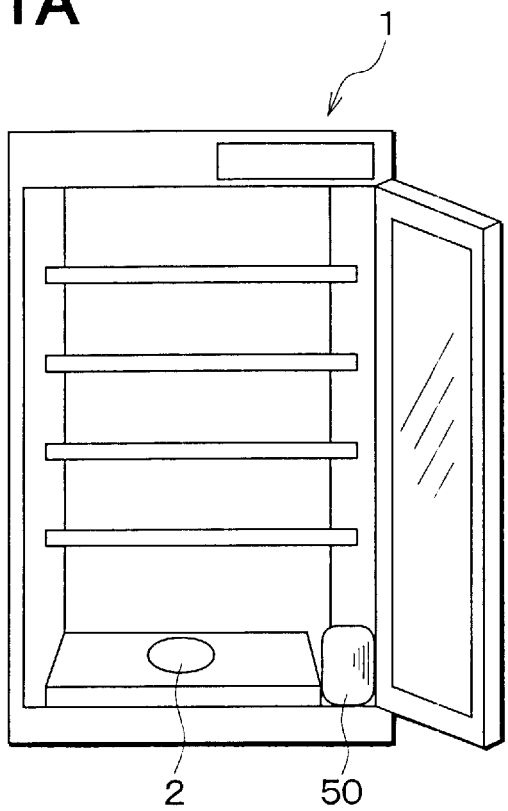
FIG. 1A is a schematic illustration of a showcase having a gas-liquid separator according to embodiments of the present invention.
Figure 1B:
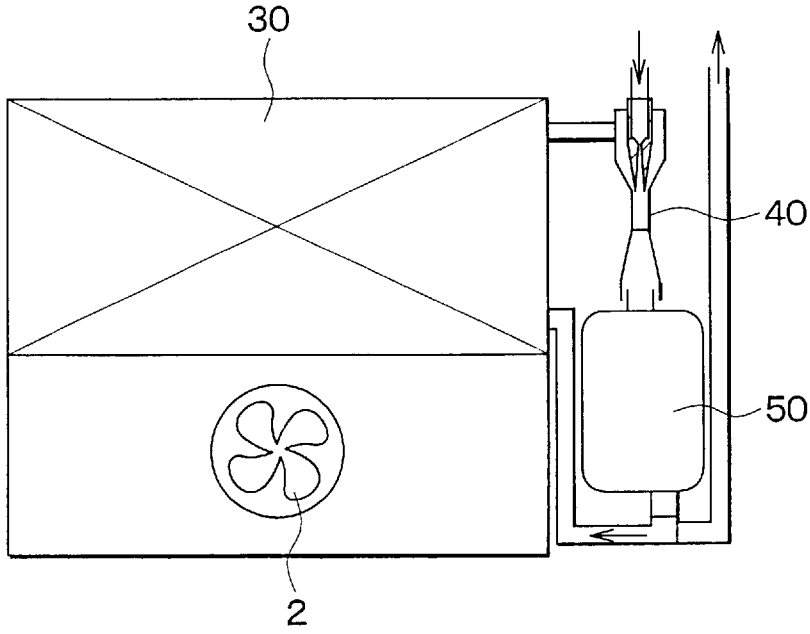
FIG. 1B is a top view of the bottom of the showcase in FIG. 1A.

As shown in FIGS. 1A and 1B, a gas-liquid separator 50 is applied to an ejector cycle for a showcase 1 that stores food at low temperatures, for example. An evaporator 30 and a blower 2 are provided at the bottom of the showcase 1.

Figure 2:
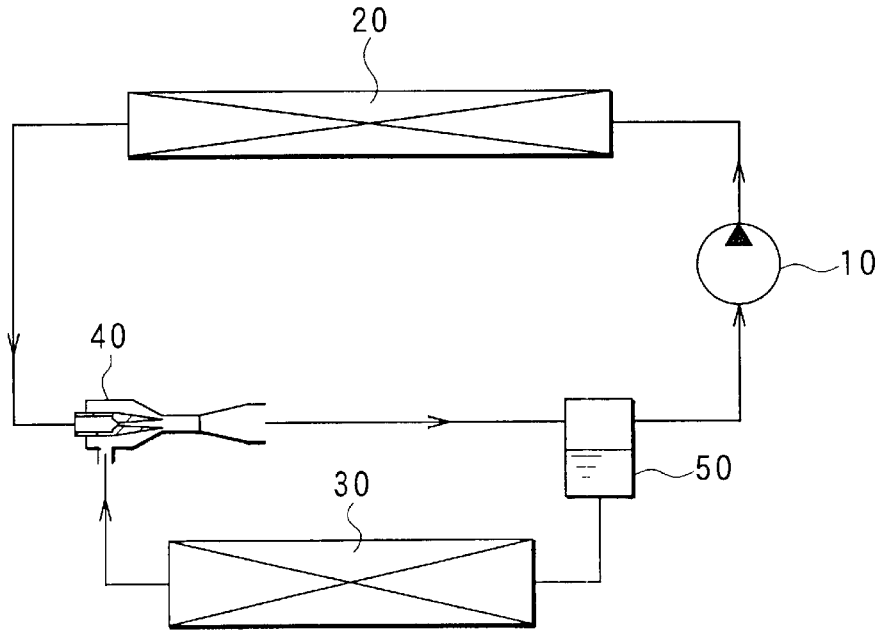
FIG. 2 is a schematic diagram of an ejector cycle according to the embodiments of the present invention.

FIG. 2 is a schematic diagram of the ejector cycle. A compressor 10 is electrically driven. The compressor 10 sucks and compresses refrigerant. A radiator 20 is a high pressure side heat exchanger. The radiator 20 performs heat-exchange between a high temperature, high pressure refrigerant discharged from the compressor 10 and outside air, to cool the refrigerant.

Here, flon is used as the refrigerant. The pressure of the refrigerant on the high pressure side is lower than a critical pressure of the refrigerant. Thus, the refrigerant is condensed in the radiator 20.

The evaporator 30 is a low pressure side heat exchanger for improving refrigerating capability. The evaporator 30 performs heat exchange between air to be blown into the showcase 1 and liquid refrigerant, and evaporates the liquid refrigerant. The ejector 40 sucks the gas refrigerant evaporated in the evaporator 30 by decompressing and expanding the refrigerant discharged from the radiator 20. Further, the ejector 40 converts expansion energy into pressure energy to increase pressure of the refrigerant to be sucked into the compressor 10.

Figure 3:
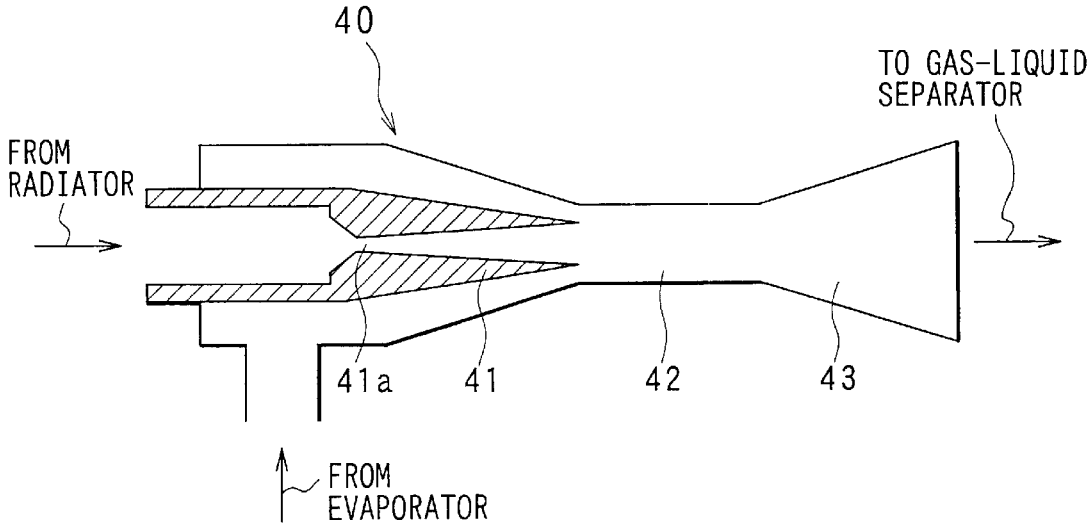
FIG. 3 is a schematic illustration of an ejector, partially includes cross-section, according to the embodiments of the present invention.

The ejector 40 includes a nozzle 41, a mixing portion 42, a diffuser 43 and the like, as shown in FIG. 3. The nozzle 41 decompresses and expands the refrigerant by converting the pressure energy of the high pressure refrigerant discharged from the radiator 20 into speed energy. The mixing portion 42 sucks the gas refrigerant evaporated in the evaporator 30 by a high-speed flow of the refrigerant jetted from the nozzle 41. The diffuser 43 increases pressure of the refrigerant by converting speed energy into pressure energy while mixing the refrigerant jetted from the nozzle 41 and the refrigerant sucked from the evaporator 30. The nozzle 41 has a throttle portion 41*a* at which a passage cross-sectional area, that is, an inner diameter, is minimized. The nozzle 41 is a divergent nozzle such that its inner diameter increases toward the mixing portion 42 from the throttle portion 41*a*.

In the mixing portion 42, the refrigerant jetted from nozzle 41 mixes with the refrigerant sucked from the evaporator 30 such that the sum of momentum of those refrigerants is maintained. Therefore, the pressure of the refrigerant increases in the mixing portion 42. In the diffuser 43, an inner diameter gradually increases toward its end (to right side in FIG. 3) so that the speed energy of the refrigerant is converted into the pressure energy. Therefore, the pressure of the refrigerant increases in the mixing portion 42 and the diffuser 43. Here, the mixing portion 42 and the diffuser 43 are referred to as a pressure increase portion.

The refrigerant discharged in the ejector 40 flows into the gas-liquid separator 50, as shown in FIG. 2. The gas-liquid separator 50 separates the refrigerant into gas refrigerant and liquid refrigerant and stores the refrigerant. The gas-liquid separator 50 discharges the gas refrigerant toward the compressor 10 and also discharges the liquid refrigerant toward the evaporator 30.

Figure 4A:
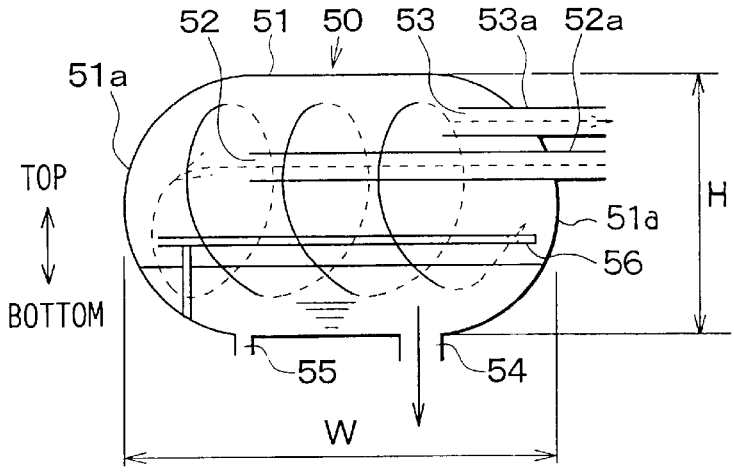
FIG. 4A is a schematic illustration of a gas-liquid separator, viewed from a side, according to the first embodiment of the present invention.
Figure 4B:
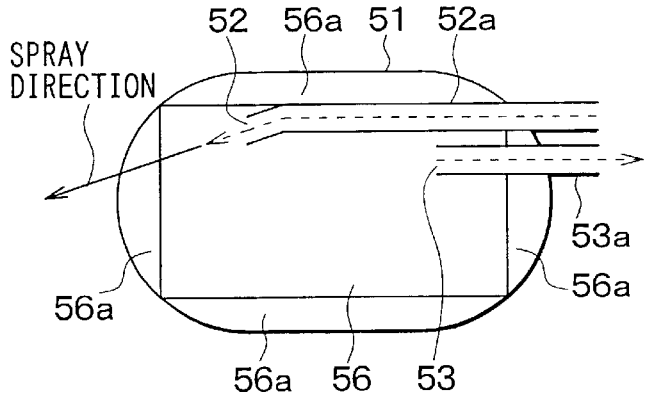
FIG. 4B is a schematic illustration of the gas-liquid separator, viewed from a top, according to the first embodiment of the present invention.
Figure 4C:
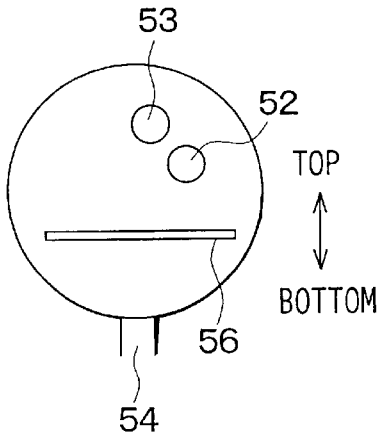
FIG. 4C is a schematic illustration of the gas-liquid separator, viewed from an end, according to the first embodiment of the present invention.

Referring to FIGS. 4A to 4C, the gas-liquid separator 50 has a tank body 51, a refrigerant inlet 52, a gas refrigerant outlet 53, a liquid refrigerant outlet 54 and an oil return port 55. The tank 51 has a substantially cylindrical shape and its ends are closed with spherical surfaces. The refrigerant flows into the tank body 51 through the refrigerant inlet 52. The gas refrigerant is discharged out from the gas refrigerant outlet 53 toward the compressor 10. The liquid refrigerant is discharged out from the liquid refrigerant outlet 54 toward the evaporator 10. The liquid refrigerant including refrigeration oil returns to the compressor 10 from the oil return portion 55.

The tank body 51 is a horizontal-type pressure vessel such that a horizontal length W is equal to or greater than a vertical length (height) H. The tank body 51 is made of metal having a high corrosion resistance, such as stainless. The tank body 51 is constructed such that the refrigerant spirally flows in the tank body 51, as shown in FIG. 4A.

Specifically, the refrigerant inlet 52 is located off center of the tank body 51, as shown in FIG. 4C. That is, the refrigerant inlet 52 is located at a distance from a horizontal longitudinal axis of the tank body 51, so that the refrigerant sprayed from the refrigerant inlet 52 flows toward the longitudinal axis of the tank body 51 and causes a turning force. Further, the refrigerant inlet 52 is directed such that an axis of the refrigerant spray direction from the refrigerant inlet 52 crosses an inner wall of the tank body 51 at an obtuse angle.

The end surface 51*a* of the tank body 51 is domed outward. With this, the axis of the refrigerant spray direction crosses the end surface 51*a* at an obtuse angle. Also, the domed end surface improves a pressure resistance of the tank body 51.

A partition wall 56 is arranged in the tank body 51 above a liquid level for dividing the tank space into a gas refrigerant space and a liquid refrigerant space. The partition wall 56 prevents the liquid refrigerant from remixing with the gas refrigerant.

The partition wall 56 does not completely divide the tank space, but communication spaces 56*a* remains between the partition wall 56 and the inner wall of the tank body 51 to allow communication between the gas refrigerant space and the liquid refrigerant space.

The refrigerant inlet 52 and gas refrigerant outlet 53 are located above the partition wall 56. The liquid refrigerant outlet 54 and oil return port 55 are located below the partition wall 56. This arrangement restricts the liquid refrigerant surface from being disturbed by the refrigerant sprayed from the refrigerant inlet 52.

An inlet pipe 52*a* connecting the refrigerant inlet 52 and a refrigerant discharge side of the ejector 40 and an outlet pipe 53*a* connecting the gas refrigerant outlet 53 and the suction side of the compressor 10 are inserted into the tank body 51 through the end surface 51*a*, as shown in FIGS. 4A and 4B.

Next, operation of the ejector cycle will be described.

When the compressor 10 starts operation, the compressor 10 draws the gas refrigerant from the gas-liquid separator 50. The compressor 10 decompresses the refrigerant and discharges it to the radiator 20. Then, the radiator 20 cools the refrigerant and discharges it to the ejector 40. The ejector 40 decompresses and expands the refrigerant at the nozzle 41 and draws the gas refrigerant from the evaporator 30.

The mixing portion 42 mixes the refrigerant from the evaporator 30 and the refrigerant from the nozzle 41. The diffuser 43 converts dynamic pressure into static pressure. Then, the refrigerant returns to the gas-liquid separator 50.

When the ejector 40 draws the refrigerant from the evaporator 30, the liquid refrigerant in the gas-liquid separator 50 is discharged into the evaporator 30. The refrigerant absorbs heat from the air to be blown into the showcase 1 and evaporates in the evaporator 30.

The tank body 51 is constructed such that the refrigerant forms a spiral stream. With this, the gas-liquid separation distance, which is the stream length of the refrigerant stream to be separated into gas refrigerant and liquid refrigerant, increases. Therefore, even in the horizontal-type vessel, the refrigerant is adequately separated into the gas refrigerant and the liquid refrigerant. Accordingly, the gas-liquid separator 50 can be mounted in a space where a height is limited, such as in the showcase 1.

The refrigerant discharged in the tank body 51 tends to expand in all directions. However, since the refrigerant inlet 52 is open at a position separated from the longitudinal axis of the tank body 51, the refrigerant flows toward the axis of the tank body 51. At this time, the refrigerant causes the turning force, thereby forming the spiral flow in the tank body 51.

Also, the refrigerant inlet 52 is directed such that the axis of the refrigerant spray direction crosses the inner wall of the tank body 51 at an obtuse angle. Further, the end surface 51*a* of the tank body 51 is domed. Therefore, the refrigerant discharge stream strikes the inner wall of the tank body 51, and generates the turning force. Accordingly, the refrigerant stream turns in the tank body 51.

Because the inlet pipe 52*a* is provided horizontally in the tank body 51, the refrigerant is sprayed out horizontally from the inlet 52. Thus, the refrigerant flows spirally about the horizontal axis of the tank body 51. However, the refrigerant can be sprayed in the vertical direction. Thus, the refrigerant flows spirally about the vertical axis.

The refrigerant discharge side of the ejector 40 connects with the end surface 51*a* of the tank body 51. That is, the ejector 40 horizontally connects with the tank body 50. Therefore, the ejector 40 that is relatively long in the horizontal direction can be easily mounted in a space which height is limited, such as in the showcase 1.

Since the gas-liquid separator 50 has the partition wall 56, the gas refrigerant is restricted to re-mixing with the liquid refrigerant.

Figure 5:
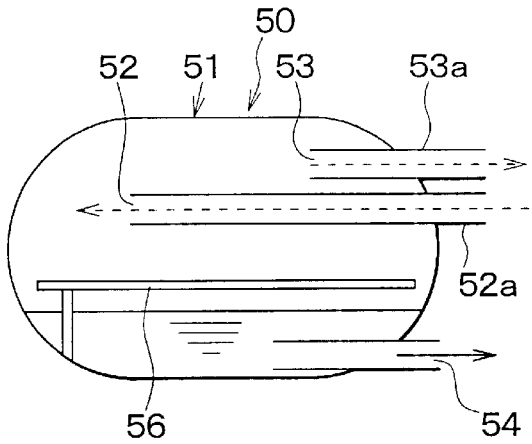
FIG. 5 is a schematic illustration of the gas-liquid separator according to the second embodiment of the present invention.

In the second embodiment, the refrigerant outlet 54 is provided to open in the horizontal direction, as shown in FIG. 5.

Figure 6:
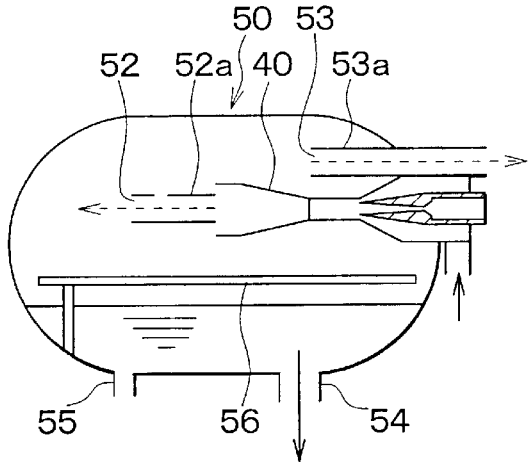
FIG. 6 is a schematic illustration of the gas-liquid separator according to the third embodiment of the present invention.

In the third embodiment, the ejector 40 is mounted inside of the tank body 51, as shown in FIG. 6. Although the ejector 40 is almost enclosed in the tank body 51 in FIG. 6, the ejector 40 can be connected such that only a part of the ejector 40 is inside of the tank body 51. With this arrangement, a mounting space of the ejector 40 decreases.

Figure 7:
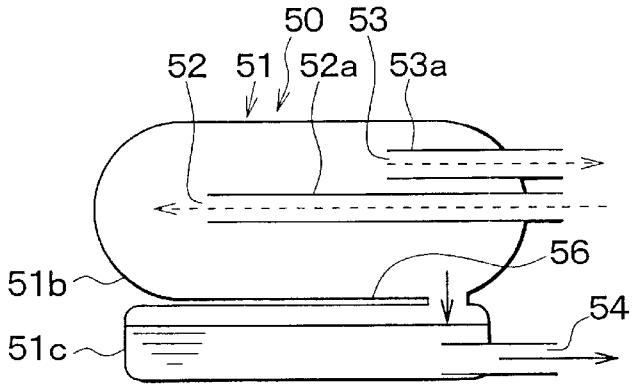
FIG. 7 is a schematic illustration of the gas-liquid separator according to the fourth embodiment of the present invention.

In the fourth embodiment, the tank body 51 has two different tank rooms 51*b*, 51*c*, as shown in FIG. 7. That is, the tank body 51 has a gas refrigerant room 51*b* and a liquid refrigerant room 51*c*, in place of separating the tank space with the partition wall 56.

In the above embodiments, the gas-liquid separator 50 is applied to the ejector cycle of the showcase 1. However, the gas-liquid separator 50 of the present invention can be used for other purposes.

Although the refrigerant inlet 52 is arranged above the partition wall 56, the refrigerant inlet 52 can be arranged below the separation wall 56, for example. Further, materials, such as carbon dioxide and hydrocarbon, can be used as the refrigerant.

The present invention should not be limited to the disclosed embodiments, but may be implemented in other ways without departing from the spirit of the invention.

What is claimed is:

1. A gas-liquid separator for an ejector cycle that includes an ejector for drawing gas refrigerant from an evaporator by decompressing refrigerant then increasing pressure of refrigerant to be sucked into a compressor, the gas-liquid separator comprising:

a tank body for separating refrigerant into gas refrigerant and liquid refrigerant, the tank body defining a refrigerant inlet through which the refrigerant is discharged into the tank body from the ejector, a gas refrigerant outlet through which the gas refrigerant is discharged toward the compressor and a liquid refrigerant outlet through which the liquid refrigerant is discharged toward the evaporator, wherein:

the tank body has a horizontal axis longer than a vertical axis; and the tank body is constructed such that the refrigerant flows spirally about the horizontal axis throughout the tank body.

2. The gas-liquid separator according to claim 1, wherein the refrigerant inlet is located at a distance from a horizontal, longitudinal axis of the tank body.

3. The gas-liquid separator according to claim 1, wherein the tank body connects with the ejector in a horizontal direction.

4. The gas-liquid separator according to claim 1, wherein the tank body connects with the ejector such that at least a part of the ejector is located in the tank body.

5. The gas-liquid separator according to claim 1, wherein the tank body includes a partition wall for dividing a tank space into a gas refrigerant space and a liquid refrigerant space, wherein the partition wall is located above a liquid level of the liquid refrigerant.

6. The gas-liquid separator according to claim 1, wherein the refrigerant inlet is directed such that an axis of the refrigerant discharge direction from the refrigerant inlet crosses an inner wall of the tank body at an obtuse angle.

7. The gas-liquid separator according to claim 1, wherein the tank body defines a curved inner wall such that the refrigerant discharged from the refrigerant inlet strikes the curved inner wall at an obtuse angle.

8. A gas-liquid separator for an ejector cycle including an ejector, the gas-liquid separator comprising:

a tank body for separating refrigerant into gas refrigerant and liquid refrigerant, the tank body including a substantially cylindrical wall portion having a horizontal longitudinal axis and first and second end surfaces, and the tank body defining a gas refrigerant outlet through which the gas refrigerant flows out of the tank body and a liquid refrigerant outlet through which the liquid refrigerant flows out of the tank body; and a refrigerant inlet pipe communicating the tank body with the ejector, wherein the refrigerant inlet pipe defines a refrigerant opening at its end, the refrigerant opening being opened inside the tank body such that refrigerant discharged from the opening is sprayed to form a spiral stream about the horizontal longitudinal axis throughout the tank body.

9. The gas-liquid separator according to claim 8, wherein the refrigerant opening is located at a distance from the horizontal longitudinal axis of the tank body.

10. The gas-liquid separator according to claim 8, wherein the horizontal longitudinal axis of the tank body is longer than a vertical axis of the tank body.

11. The gas-liquid separator according to claim 8, further comprising:

a partition wall separating a tank space into a liquid refrigerant space and a gas refrigerant space, wherein the partition wall is placed horizontally above a liquid level.

12. The gas-liquid separator according to claim 8, wherein the refrigerant opening is directed such that an axis of a refrigerant spray direction crosses an inner wall of the tank body at an obtuse angle.

13. The gas-liquid separator according to claim 8, wherein the refrigerant inlet pipe horizontally passes through the first end surface of the tank body.

14. The gas-liquid separator according to claim 8, wherein the ejector is connected to the first end surface of the tank body.

15. The gas-liquid separator according to claim 8, wherein the second end surface of the tank body is curved such that a refrigerant stream sprayed from the refrigerant opening strikes an inner wall of the tank body at an obtuse angle.

16. The gas-liquid separator according to claim 2, wherein the gas refrigerant outlet is open in a horizontal direction and is located higher than the refrigerant inlet.

17. The gas-liquid separator according to claim 2, wherein the refrigerant inlet and the gas refrigerant outlet are open in horizontal directions.

18. The gas-liquid separator according to claim 1, wherein the tank body has a cylindrical wall having a horizontal longitudinal axis, and a first domed end wall and a second domed end wall at longitudinal ends of the cylindrical wall, the refrigerant inlet is located between the second domed end wall and a middle position of the cylindrical wall with respect to a horizontal direction and opens toward the second domed end wall so that the refrigerant sprayed from the refrigerant inlet strikes the second domed end wall at an obtuse angle, and the gas refrigerant outlet is located proximate to the first domed end wall.

19. The gas-liquid separator according to claim 12, wherein the second end surface is in a form of dome and the inner wall is included in the second end surface.

20. The gas-liquid separator according to claim 13, wherein the opening of the inlet pipe is open in a horizontal direction and located between the second end surface and a middle position of the tank body with respect to the horizontal direction.

21. The gas-liquid separator according to claim 20, wherein the gas refrigerant outlet is located proximate to the first end surface.

22. The gas-liquid separator according to claim 21, wherein the liquid refrigerant outlet is located between the first end surface and the middle position of the tank body with respect to the horizontal direction.

23. The gas-liquid separator according to claim 14, wherein the ejector is horizontally disposed in the tank body and connects to the inlet pipe on a side opposite to the opening, and the opening is located between the second end surface and a middle position of the tank body with respect to a horizontal direction.

24. The gas-liquid separator according to claim 23, wherein the gas refrigerant outlet is located between the first end surface and the middle position of the tank body with respect to the horizontal direction.

25. A gas-liquid separator for an ejector cycle that includes an ejector for drawing gas refrigerant from an evaporator by decompressing refrigerant, the gas-liquid separator comprising:

a tank body for separating refrigerant into gas refrigerant and liquid refrigerant, the tank body defining a refrigerant inlet through which the gas refrigerant and the liquid refrigerant are discharged into the tank body from the ejector, a gas refrigerant outlet through which the gas refrigerant is discharged toward the compressor and a liquid refrigerant outlet through which the liquid refrigerant is discharged toward the evaporator, wherein the tank body is constructed such that the gas refrigerant and the liquid refrigerant flow throughout the tank body.

* * * * *